US009957731B2

(12) United States Patent
Wong

(10) Patent No.: US 9,957,731 B2
(45) Date of Patent: May 1, 2018

(54) LOCKING DEVICE WITH LOCKABLE SPINDLE FOLLOWER LINKAGE

(71) Applicant: Borger Limited, Hong Kong (HK)

(72) Inventor: Ngai Kwong Wong, Hong Kong (HK)

(73) Assignee: Borger Limited, Hong Kong (HK)

( * ) Notice: Subject to any disclaimer, the term of this patent is extended or adjusted under 35 U.S.C. 154(b) by 445 days.

(21) Appl. No.: 14/821,841

(22) Filed: Aug. 10, 2015

(65) Prior Publication Data

US 2016/0053520 A1 Feb. 25, 2016

Related U.S. Application Data

(60) Provisional application No. 62/039,902, filed on Aug. 20, 2014.

(51) Int. Cl.
*E05C 1/06* (2006.01)
*E05B 13/00* (2006.01)
(Continued)

(52) U.S. Cl.
CPC ..... *E05B 13/004* (2013.01); *E05B 35/008* (2013.01); *E05C 1/12* (2013.01)

(58) Field of Classification Search
CPC ..... E05B 13/004; E05B 35/008; E05B 15/04; E05B 17/2038; E05B 17/22; E05B 55/12; E05C 5/00; Y10T 292/0983; Y10T 292/1021; Y10T 292/57; Y10T 70/5832; Y10T 70/713; Y10T 292/06; Y10T 292/0877; Y10T 292/0878; Y10T 292/0908; Y10T 292/0969; Y10T 292/0972; Y10T 292/0974; Y10T 292/0976; Y10T 292/0977; Y10T 292/0984; Y10T 292/0985; Y10T 292/1003; Y10T 292/1028; Y10T 292/1031; Y10T 292/1037; Y10T 292/1097; Y10T 292/1098; Y10T 292/62; Y10T 292/88; Y10T 292/91;
(Continued)

(56) References Cited

U.S. PATENT DOCUMENTS 4,390,197 A * 6/1983 Butts ..... E05B 47/0673 292/144
5,141,268 A * 8/1992 Keller ..... E05B 17/005 292/150
(Continued)

OTHER PUBLICATIONS

1st Office Action of counterpart Chinese Patent Application No. 201510513028.X dated Apr. 20, 2017.

*Primary Examiner* — Mark A Williams

(57) ABSTRACT

A locking device includes a spindle follower linkage coupled with a latch and rotatable between a locked position and an unlocked position. A locking block is formed with a pin hole. A pin is insertable through an opening of a housing and into the pin hole. A locking block spring for biasing the locking block in a first position where the pin is inserted into the pin hole and the locking block is disengaged from the spindle follower linkage, and a second position where the pin is removed and the locking block is pushed towards and engaged with the spindle follower linkage, thereby holding the spindle follower linkage in the locked position. A spring unit is held inside the pin hole to facilitate ejection of the pin.

16 Claims, 10 Drawing Sheets

(51) Int. Cl.
*E05B 35/00* (2006.01)
*E05C 1/12* (2006.01)

(58) Field of Classification Search
CPC . Y10T 292/93; Y10T 292/96; Y10T 70/5195; Y10T 70/5456; Y10T 70/5496; Y10T 70/5504; Y10T 70/7062; Y10T 70/7079; Y10T 70/7107; Y10T 70/7254; Y10T 70/7424; Y10T 70/7712; Y10T 70/7819
See application file for complete search history.

(56) References Cited

U.S. PATENT DOCUMENTS 5,678,870 A * 10/1997 Pelletier ..... E05B 55/12 292/169.16
5,685,182 A * 11/1997 Chhatwal ..... E05B 17/22 292/144
5,787,744 A * 8/1998 Berger ..... E05B 17/0058 292/350
5,953,942 A * 9/1999 Doucet ..... E05B 47/0688 70/149
2011/0079057 A1* 4/2011 Frolov ..... E05B 47/0673 70/91

* cited by examiner

LOCKING DEVICE WITH LOCKABLE SPINDLE FOLLOWER LINKAGE

CROSS-REFERENCE TO RELATED APPLICATIONS

This application claims the benefit of U.S. Provisional Patent Application No. 62/039,902, filed Aug. 20, 2014, the entire content of which is hereby incorporated by reference.

FIELD OF THE TECHNOLOGY

The present application relates to a locking device, and specifically relates to a locking device with lockable spindle follower linkage.

BACKGROUND

When a door furniture is removed from the door, the spindle follower linkage of the locking device will be exposed. The spindle follower linkage can then be manipulated. By inserting a suitable tool, the latch can be easily unlatched.

There is a need to provide a locking device with lockable spindle follower linkage to prevent a latch from being unlatched and to lock the latch in its latched position.

SUMMARY

In one aspect, the present application is directed to a locking device with a lockable spindle follower linkage, including: (a) a latch; (b) a latch linkage having one end coupled with the latch; (c) a spindle follower linkage coupled with another end of the latch linkage, the spindle follower linkage being rotatable about an axis of rotation between a locked position where the latch is in an extended position and an unlocked position where the latch is in a retracted position; (d) a locking block formed with an elongate pin hole parallel to and spaced apart from the axis of rotation; wherein the pin hole may include an outer open end and an inner open end, and wherein a diameter of the outer open end is the same as a diameter of the pin hole, and a diameter of the inner open end is smaller than the diameter of the pin hole; (e) a locking block cover attached to one side of the locking block where the outer open end of the pin hole is located, and the locking block cover is formed with a cover opening in alignment with the pin hole, wherein a diameter of the cover opening is smaller than the diameter of the pin hole; (f) a pin insertable through an opening of a housing of the locking device and the cover opening and into the pin hole; (g) a spring unit held inside the pin hole to facilitate ejection of the pin from the pin hole, the spring unit comprising a pin-actuating spring have two opposite ends and two steel balls disposed at the two opposite ends of the spring respectively; and (h) a locking block spring provided in a transverse recess formed on the locking block transverse to the pin hole for exerting a force to bias the locking block in a first bias position where the pin is inserted through the opening of the housing and into the pin hole and the locking block is held by the pin and is disengaged from the spindle follower linkage, and a second bias position where the pin is removed from the pin hole and the locking block is pushed towards and engaged with the spindle follower linkage, thereby preventing rotation of the spindle follower linkage and holding it in the locked position.

The locking block may be engageable with the spindle follower linkage by an engagement mechanism including a recess formed on the spindle follower linkage and a corresponding projection extending from the locking block and engageable with the recess.

The pin may include an insert end adapted to be inserted into the pin hole, and a gripping end adapted to extend outwardly from the housing of the locking device to facilitate gripping of the pin by fingers of a user. The gripping end may be formed with an enlarged head.

The latch, the latch linkage, the spindle follower linkage, the locking block and the pin may be made of metal.

In another aspect, the present application is directed to a locking device, including: (a) a spindle follower linkage coupled with a latch, the spindle follower linkage being rotatable about an axis of rotation between a locked position where the latch is in an extended position and an unlocked position where the latch is in a retracted position; (b) a locking block formed with an elongate pin hole parallel to and spaced apart from the axis of rotation; (c) a pin insertable through an opening of a housing of the locking device and into the pin hole; and (d) a locking block spring provided in a transverse recess formed on the locking block transverse to the pin hole for exerting a force to bias the locking block in a first bias position where the pin is inserted through the opening of the housing and into the pin hole and the locking block is held by the pin and is disengaged from the spindle follower linkage, and a second bias position where the pin is removed from the pin hole and the locking block is pushed towards and engaged with the spindle follower linkage, thereby preventing rotation of the spindle follower linkage and holding it in the locked position.

A spring unit may be held inside the pin hole to facilitate ejection of the pin from the pin hole. The spring unit may include a pin-actuating spring have two opposite ends and two steel balls disposed at the two opposite ends of the spring respectively.

The pin hole may include an outer open end for passing therethrough the pin and an inner open end, and wherein a diameter of the outer open end may be the same as a diameter of the pin hole, and a diameter of the inner open end may be smaller than the diameter of the pin hole. The locking block may include a locking block cover attached to one side thereof where the outer open end of the pin hole may be located, and the locking block cover may be formed with a cover opening in alignment with the pin hole, wherein a diameter of the cover opening may be smaller than the diameter of the pin hole.

The locking block may be engageable with the spindle follower linkage by an engagement mechanism. The engagement mechanism may include a recess formed on the spindle follower linkage and a corresponding projection extending from the locking block and engageable with the recess.

The pin may include an insert end adapted to be inserted into the pin hole, and a gripping end adapted to extend outwardly from the housing of the locking device to facilitate gripping of the pin by fingers of a user. The gripping end may be formed with an enlarged head.

The latch, the spindle follower linkage, the locking block and the pin may be made of metal.

The present application is also directed to a door assembly including the locking device.

Although the locking device with lockable spindle follower linkage is shown and described with respect to certain embodiments, it is obvious that equivalents and modifications will occur to others skilled in the art upon the reading and understanding of the specification. The locking device with lockable spindle follower linkage in the present application includes all such equivalents and modifications, and is limited only by the scope of the claims.

BRIEF DESCRIPTION OF THE DRAWINGS

Specific embodiments of the locking device with lockable spindle follower linkage will now be described by way of example with reference to the accompanying drawings wherein.

DETAILED DESCRIPTION

Reference will now be made in detail to a preferred embodiment of the locking device with lockable spindle follower linkage, examples of which are also provided in the following description. Exemplary embodiments of the locking device with lockable spindle follower linkage are described in detail, although it will be apparent to those skilled in the relevant art that some features that are not particularly important to an understanding of the locking device with lockable spindle follower linkage may not be shown for the sake of clarity.

Furthermore, it should be understood that the locking device with lockable spindle follower linkage is not limited to the precise embodiments described below and that various changes and modifications thereof may be effected by one skilled in the art without departing from the spirit or scope of the protection. For example, elements and/or features of different illustrative embodiments may be combined with each other and/or substituted for each other within the scope of this disclosure and appended claims.

It should be noted that throughout the specification and claims herein, when one element is said to be "coupled" or "connected" to another, this does not necessarily mean that one element is fastened, secured, or otherwise attached to another element. Instead, the term "coupled" or "connected" means that one element is either connected directly or indirectly to another element or is in mechanical or electrical communication with another element.

FIGS. 1-9 show different views of a locking device according to an embodiment of the present application, and FIGS. 10-18 show various views of various parts of the locking device.

Figure 1:
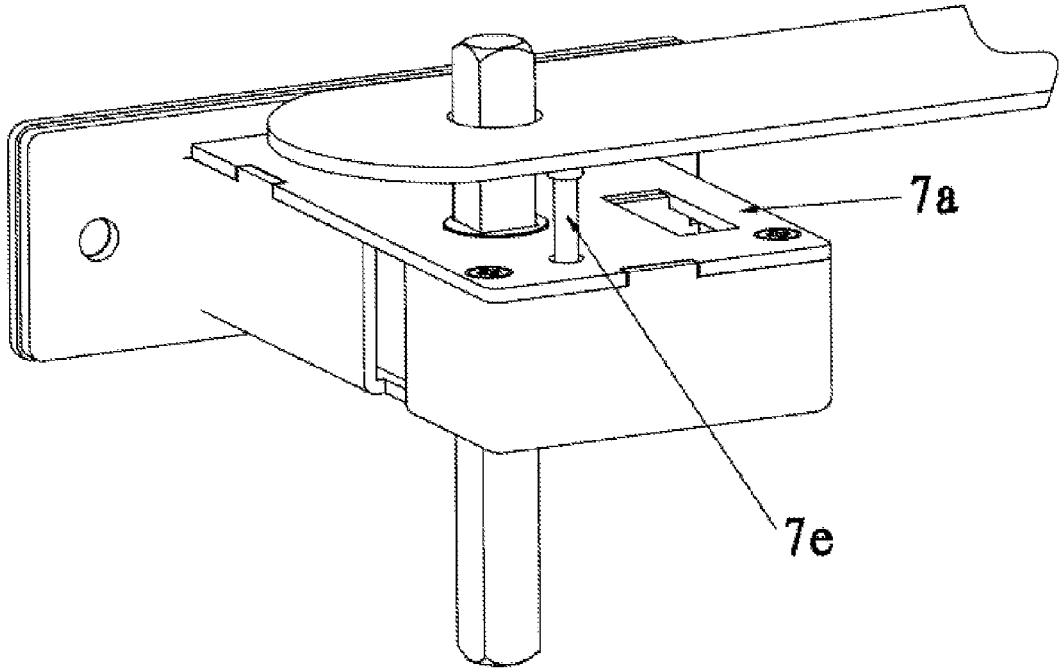
FIG. 1 is a perspective view of the locking device according to an embodiment of the present application.
Figure 2:
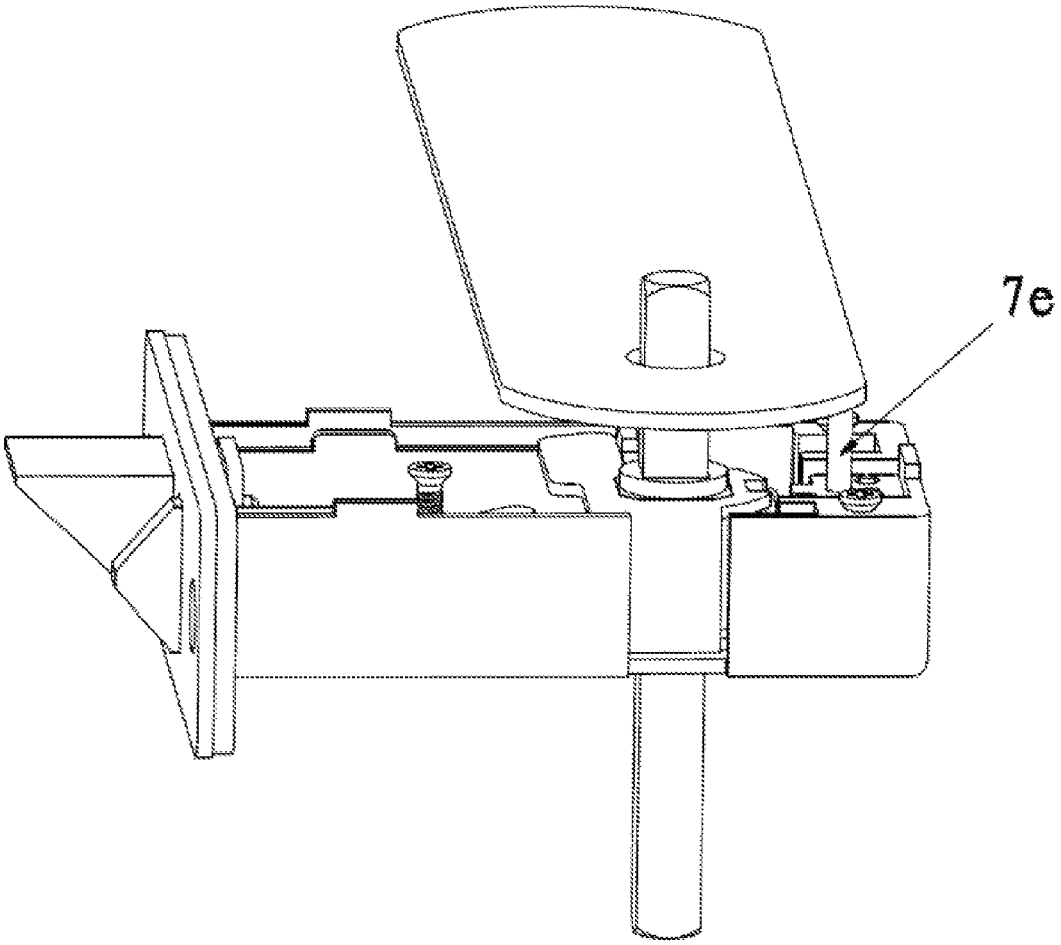
FIG. 2 is a perspective view of the locking device according to an embodiment of the present application, illustrating the latch being extended.
Figure 3:
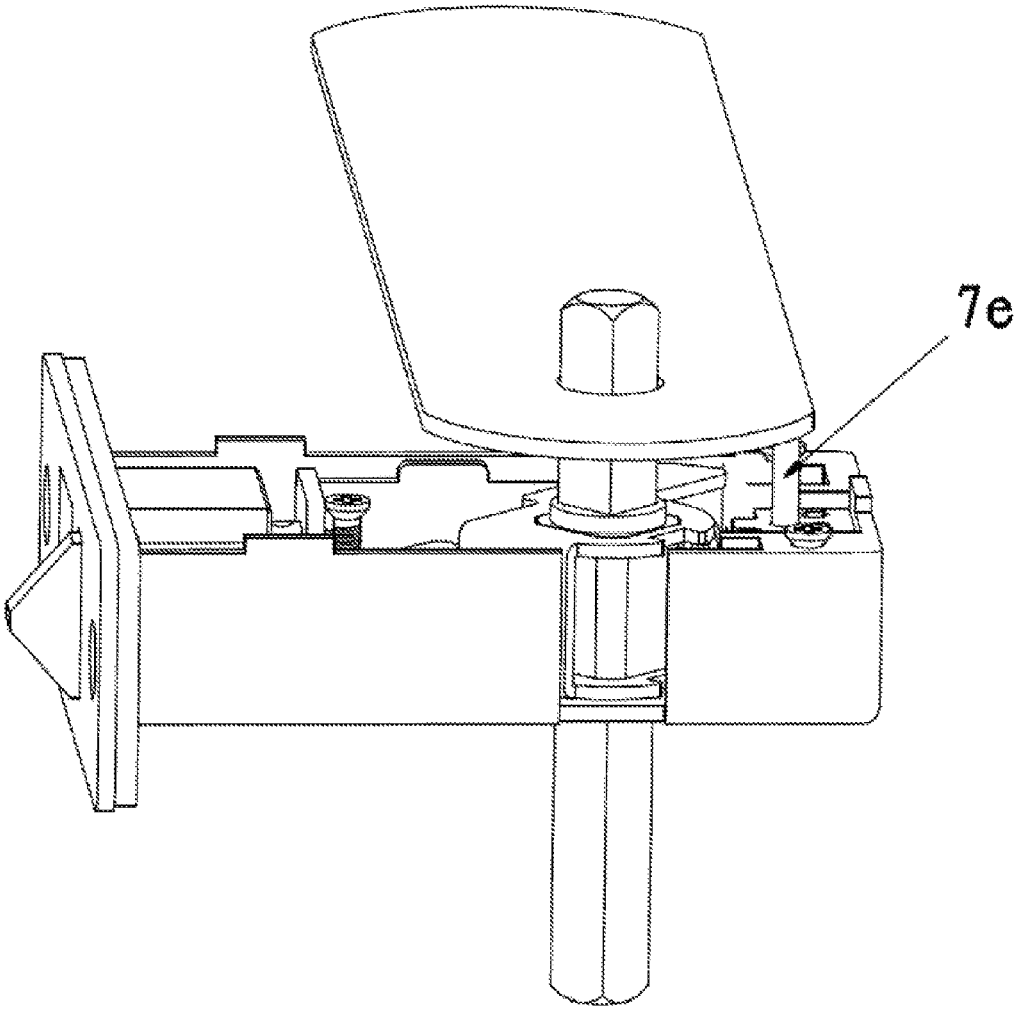
FIG. 3 is a perspective view of the locking device according to an embodiment of the present application, illustrating the latch being retracted.
Figure 4:
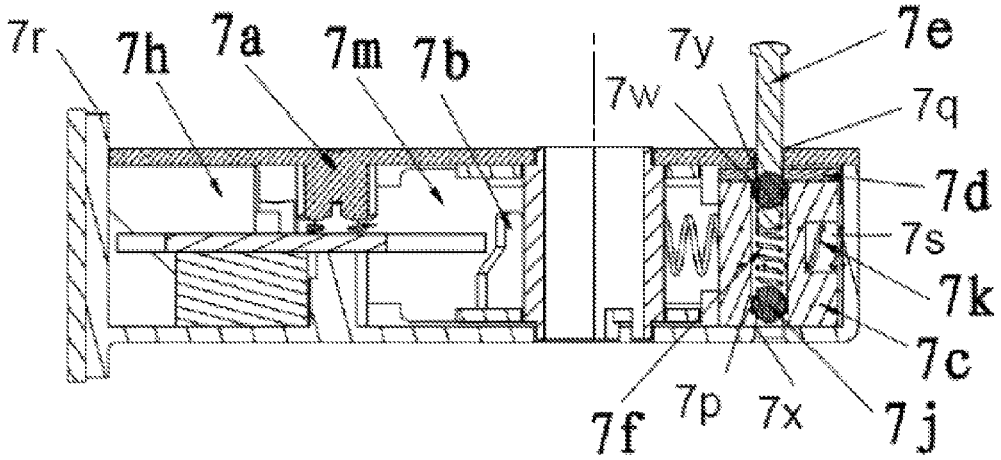
FIG. 4 is a section view of the locking device according to an embodiment of the present application, illustrating the latch being retracted and the locking block being disengaged.
Figure 8:
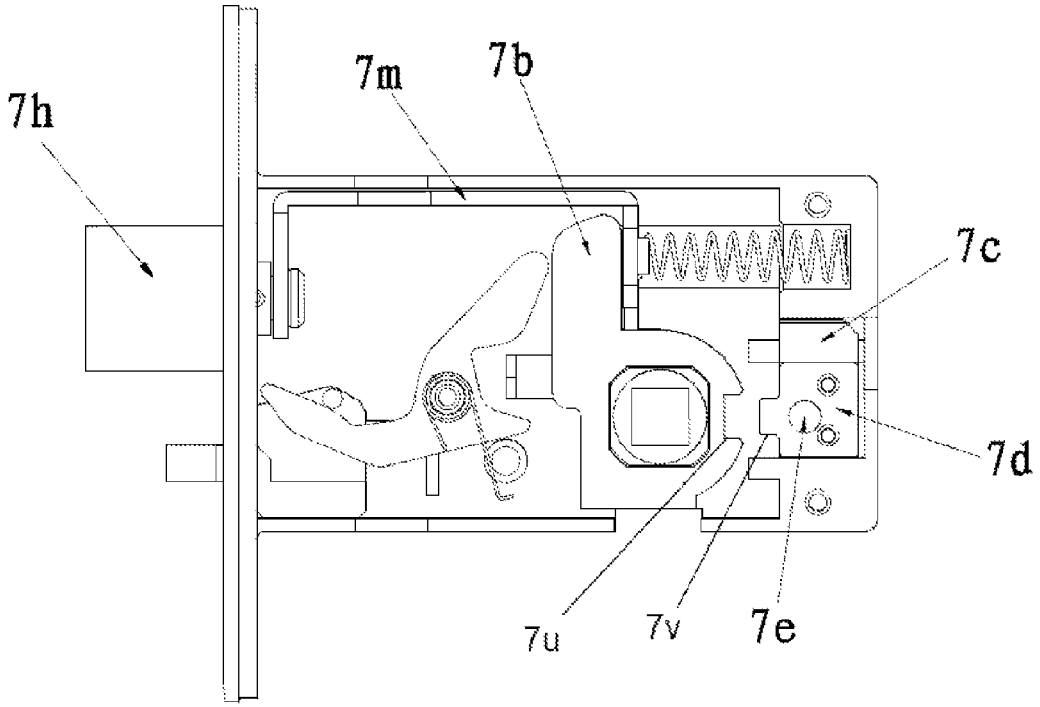
FIG. 8 is a side view of the locking device illustrating the latch being extended and the locking block being disengaged with the pin being inserted in the pin hole.

As best illustrated in FIGS. 4 and 8, the locking device may include a latch 7*h*, a latch linkage 7*m* and a spindle follower linkage 7*b*. The latch 7*h* may be a common door latch. The latch linkage 7*m* may have two opposite ends. One end of the latch linkage 7*m* may be coupled with the latch 7*h*, and the other end of the latch linkage 7*m* may be coupled with the spindle follower linkage 7*b*.

Figure 7:
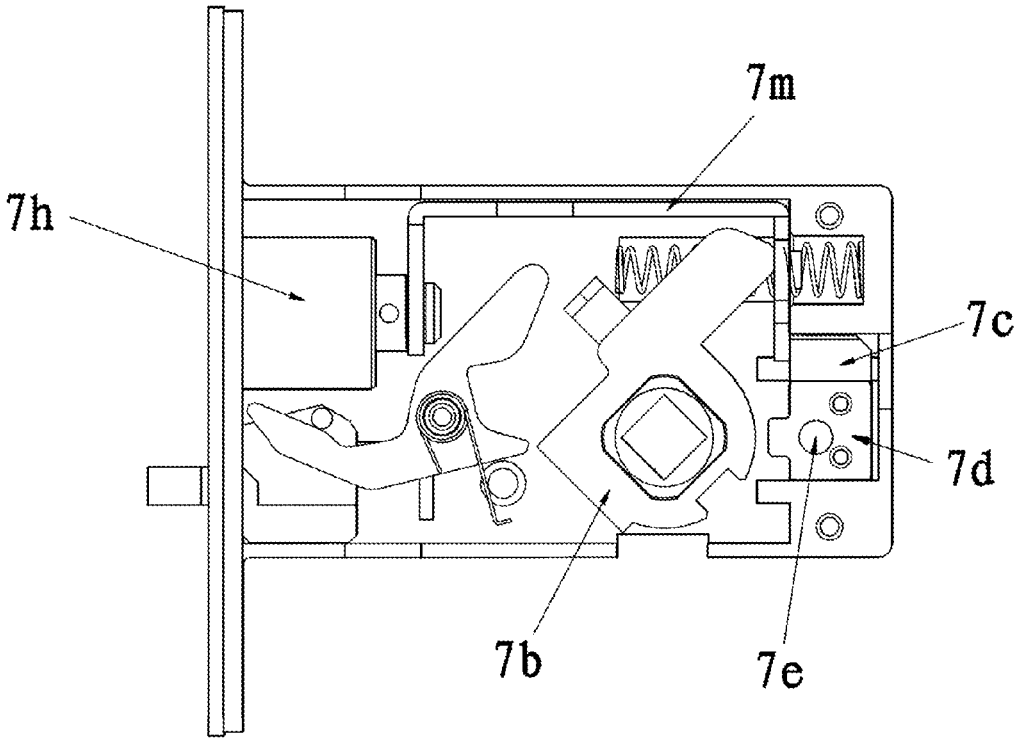
FIG. 7 is a side view of the locking device illustrating the latch being retracted and the locking block being disengaged with the pin being inserted in the pin hole.

The spindle follower linkage 7*b* can be rotatable about an axis of rotation X between a locked position where the latch 7*h* is in a latched or extended position, as shown in FIG. 8, and an unlocked position where the latch 7*h* is in an unlatched or retracted position, as shown in FIG. 7.

The locking device may include a locking block 7*c* formed with an elongate pin hole 7*p* parallel to and spaced apart from the axis of rotation X. A pin 7*e* may be insertable through an opening 7*q* of a cover 7*a* of a housing 7*r* of the locking device and into the pin hole 7*p*. The details of the pin 7*e* will be described later.

Figure 5:
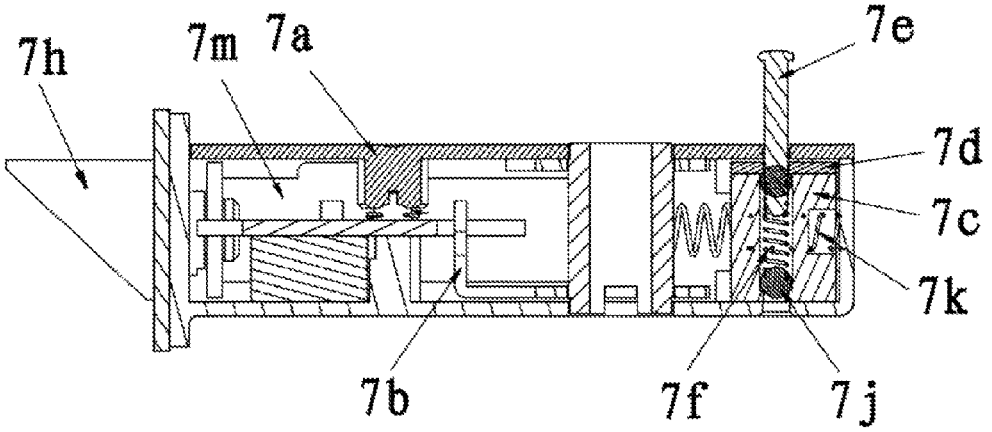
FIG. 5 is a section view of the locking device according to an embodiment of the present application, illustrating the latch being extended and the locking block being disengaged.
Figure 6:
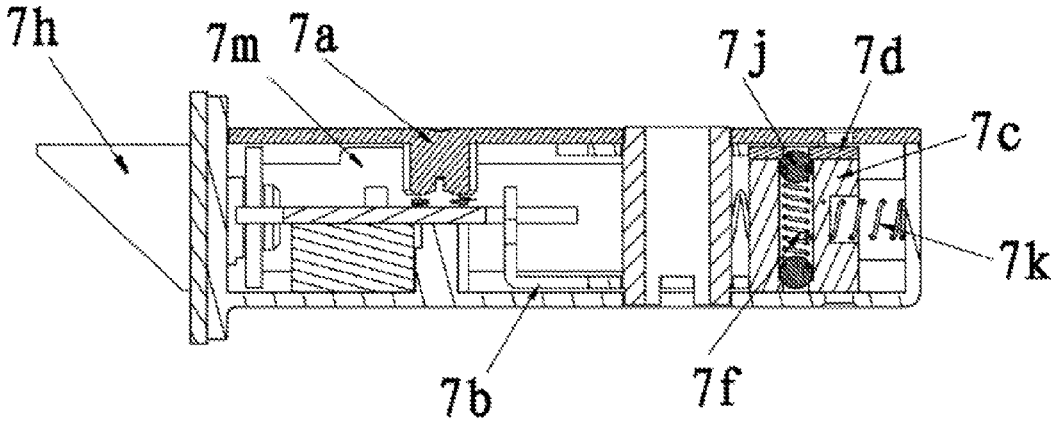
FIG. 6 is a section view of the locking device according to an embodiment of the present application, illustrating the latch locked in the extended position and the locking block being engaged.
Figure 9:
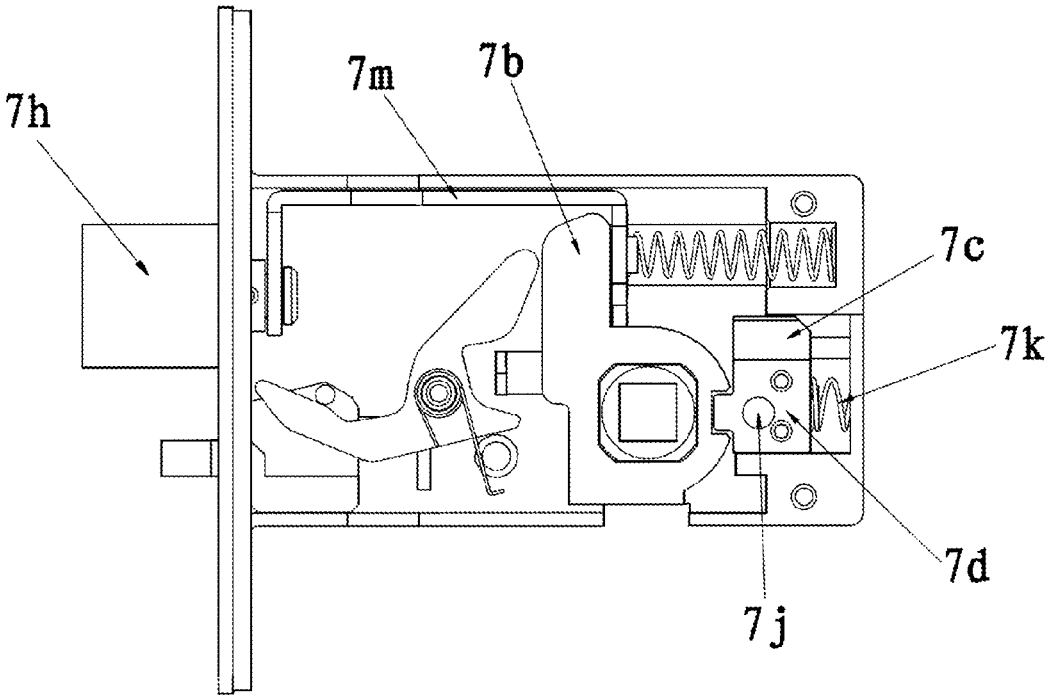
FIG. 9 is a side view of the locking device illustrating the latch being extended and the locking block being engaged.

The locking device may further include a locking block spring 7*k*. The locking block spring 7*k* may be provided in a transverse recess 7*s* formed on the locking block 7*c* transverse to the pin hole 7*p*. The locking block spring 7*k* can exert a force to bias the locking block 7*c* in a first bias position, as shown in FIGS. 5 and 8, where the pin 7*e* is inserted through the opening 7*q* of the housing 7*r* and into the pin hole 7*p* and the locking block 7*c* is held by the pin 7*e* and is disengaged from the spindle follower linkage 7*b*, and a second bias position, as shown in FIGS. 6 and 9, where the pin 7*e* is removed from the pin hole 7*p* and the locking block 7*c* is pushed towards and engaged with the spindle follower linkage 7*b*. When the locking block 7*c* is engaged with the spindle follower linkage 7*b*, the locking block 7*c* prevents rotation of the spindle follower linkage 7*b*, and therefore holds the spindle follower linkage 7*b* in the locked position.

In normal operation, the pin 7*e* is inserted through the opening 7*q* of the housing 7*r* and into the pin hole 7*p* and the locking block 7*c* is held by the pin 7*e* and is disengaged from the spindle follower linkage 7b. The spindle follower linkage 7b is free to rotate between the locked position where the latch 7h is extended, and an unlocked position where the latch 7h is retracted.

To lock the spindle follower linkage 7b, the pin 7e is removed from the pin hole 7p and the locking block 7c is pushed towards and engaged with the spindle follower linkage 7b by the spring action of the locking block spring 7k. When the locking block 7c is engaged with the spindle follower linkage 7b, the locking block 7c prevents rotation of the spindle follower linkage 7b, and therefore holds the spindle follower linkage 7b in the locked position.

The locking block 7c can be engageable with the spindle follower linkage 7b by any possible engagement mechanism. According to the illustrated embodiment, the engagement mechanism may include a recess 7u formed on the spindle follower linkage 7b and a corresponding projection 7v extending from the locking block 7c and engageable with the recess 7u. It is understood that the recess 7u can be formed on the locking block 7c instead, and the projection 7v can be formed on the spindle follower linkage 7b. In the present embodiment, both the recess 7u and projection 7v have a generally rectangular cross section.

The locking device may further include a spring unit provided inside the pin hole 7p to facilitate ejection of the pin 7e from the pin hole 7p. According to the illustrated embodiment, the spring unit may include a pin-actuating spring 7f having two opposite ends and two steel balls 7j disposed at the two opposite ends of the pin-actuating spring 7f respectively.

According to the illustrated embodiment, the pin hole 7p may include an outer open end 7w for passing therethrough the pin 7e, and an inner open end 7x. The diameter of the outer open end 7w can be the same as the diameter of the pin hole 7p, and the diameter of the inner open end 7x can be smaller than the diameter of the pin hole 7p.

The locking block 7c may further include a locking block cover 7d attached to one side thereof where the outer open end 7w of the pin hole 7p is located. The locking block cover 7d may be formed with a cover opening 7y in alignment with the pin hole 7p, and the diameter of the cover opening 7y can be smaller than the diameter of the pin hole 7p.

With the above-mentioned construction of the pin hole 7p and the locking block cover 7d, the spring unit having the spring pin-actuating spring 7f and the two steel balls 7j can be securely held inside the pin hole 7p.

Figure 14:
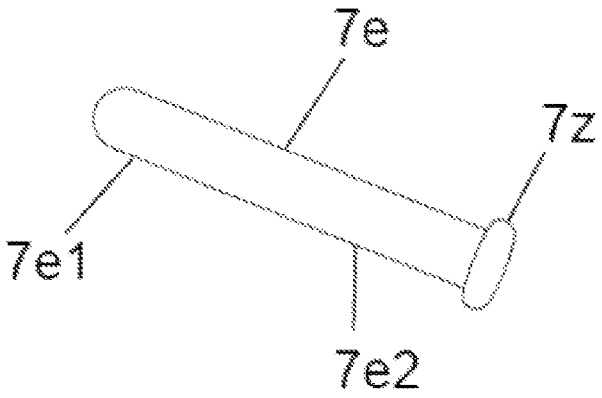
FIG. 14 is a side view of the pin of the locking device according to an embodiment of the present application.

As depicted in FIG. 14, the pin 7e may include an insert end 7e1 adapted to be inserted into the pin hole 7p, and a gripping end 7e2 adapted to extend outwardly from the housing 7r of the locking device to facilitate gripping of the pin 7e by fingers of a user. According to the illustrated embodiment, the gripping end 7e2 can be formed with an enlarged head 7z.

Figure 10:
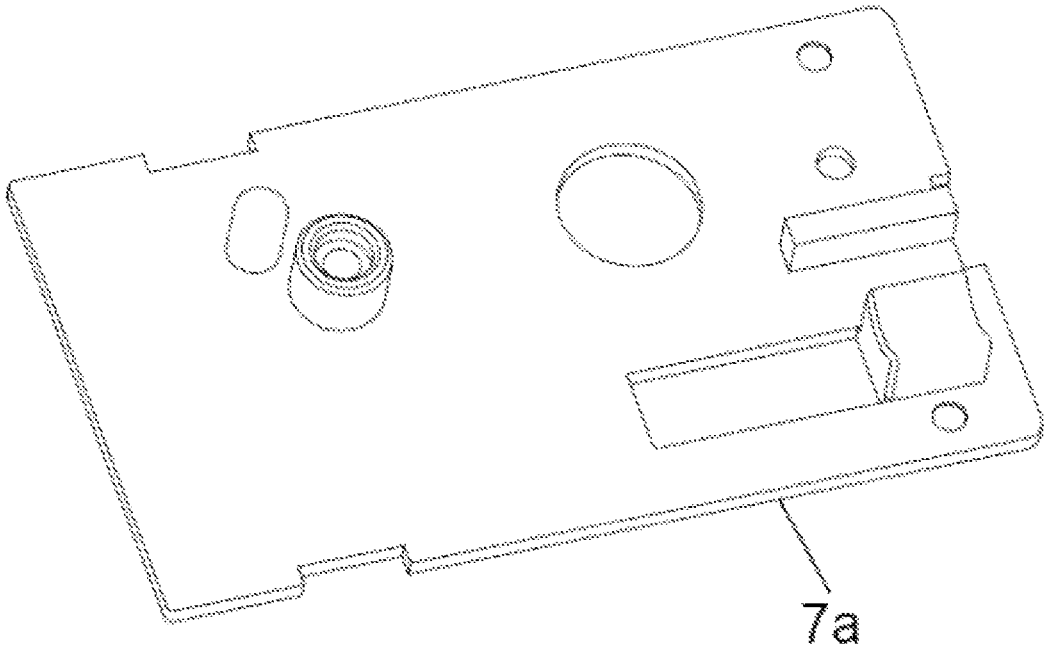
FIG. 10 is a perspective view of the cover of the locking device according to an embodiment of the present application.

FIG. 10 is a perspective view of the cover 7a of the locking device according to an embodiment of the present application. The cover 7a may be generally rectangular in shape and may be made from a metal plate.

Figure 11:
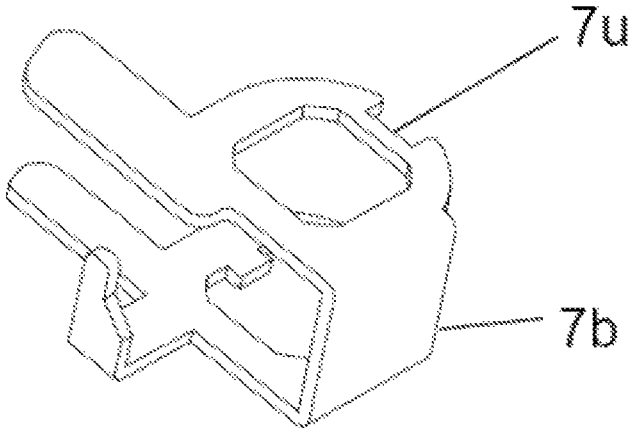
FIG. 11 is a perspective view of the spindle follower linkage of the locking device according to an embodiment of the present application.

FIG. 11 is a perspective view of the spindle follower linkage 7b of the locking device according to an embodiment of the present application. The spindle follower linkage 7b may include openings for holding therein a shaft such as a door knob shaft. The spindle follower linkage 7b may be made from a metal plate.

Figure 12:
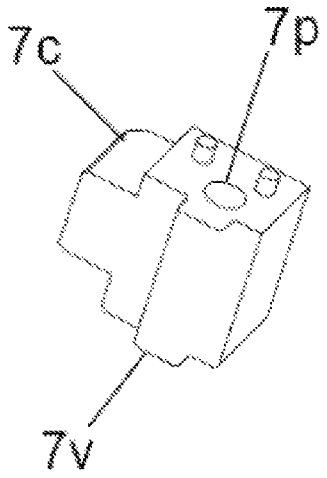
FIG. 12 is a perspective view of the locking block of the locking device according to an embodiment of the present application.

FIG. 12 is a perspective view of the locking block 7c of the locking device according to an embodiment of the present application. The locking block 7c may be generally in the shape of a block formed with a pin hole 7p and a projection 7v. The locking block 7c may also be made of metal.

Figure 13:
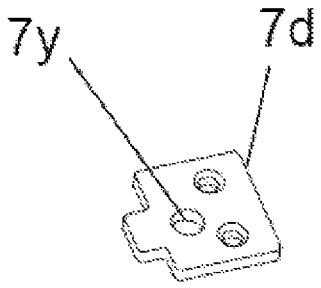
FIG. 13 is a perspective view of the locking block cover of the locking device according to an embodiment of the present application.

FIG. 13 is a perspective view of the locking block cover 7d of the locking device according to an embodiment of the present application. The locking block cover 7d is adapted to attach to one side of the locking block 7c. The locking block cover 7d may also be made of metal.

FIG. 14 is a side view of the pin 7e of the locking device according to an embodiment of the present application. The pin 7e has a pin body with circular cross section and an enlarged pin head 7z. The pin 7e may be made of metal or other suitable material.

Figure 15:
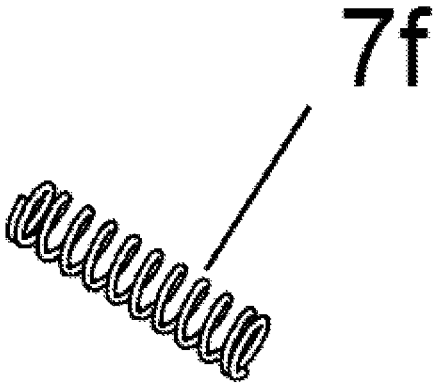
FIG. 15 is a side view of the pin spring of the locking device according to an embodiment of the present application.

FIG. 15 is a side view of the pin-actuating spring 7f of the locking device according to an embodiment of the present application. The pin-actuating spring 7f can be a coil spring. It is understood that the pin-actuating spring 7f is so constructed that it can fit into the pin hole 7p and can be actuated and compressed by the pin 7e.

Figure 16:
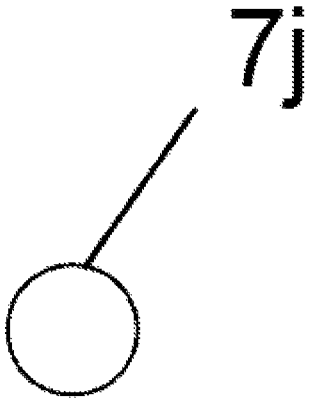
FIG. 16 is a side view of the steel ball of the locking device according to an embodiment of the present application.

FIG. 16 is a side view of the steel ball 7j of the locking device according to an embodiment of the present application. The steel ball 7j has a size that can fit in the pin hole 7p.

Figure 17:
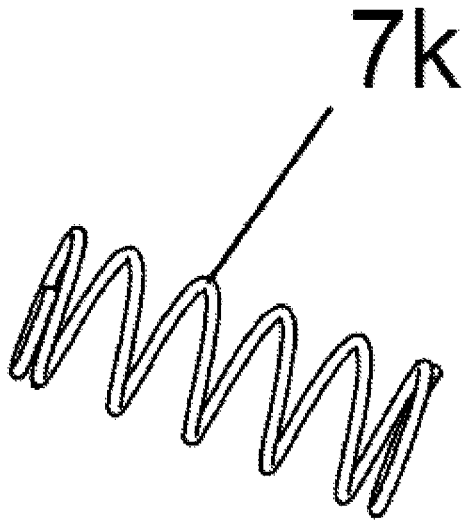
FIG. 17 is a side view of the locking block spring of the locking device according to an embodiment of the present application.

FIG. 17 is a side view of the locking block spring 7k of the locking device according to an embodiment of the present application. It can be seen that the locking block spring 7k is shorter than the pin-actuating spring 7f. The locking block spring 7k can be a coil spring or other appropriate spring such as a spring plate.

Figure 18:
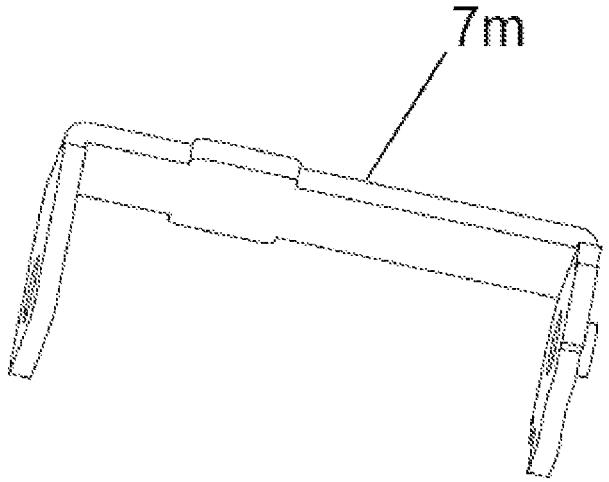
FIG. 18 is a perspective view of the latch linkage of the locking device according to an embodiment of the present application.

FIG. 18 is a perspective view of the latch linkage 7m of the locking device according to an embodiment of the present application. The latch linkage 7m may also be made of metal.

While the locking device with lockable spindle follower linkage has been shown and described with particular references to a number of preferred embodiments thereof, it should be noted that various other changes or modifications may be made without departing from the scope of the appended claims.

What is claimed is:

1. A locking device with a lockable spindle follower linkage, the locking device comprising:

(a) a latch;

(b) a latch linkage having one end coupled with the latch;

(c) a spindle follower linkage coupled with another end of the latch linkage, the spindle follower linkage being rotatable about an axis of rotation between a locked position where the latch is in an extended position and an unlocked position where the latch is in a retracted position;

(d) a locking block formed with an elongate pin hole parallel to and spaced apart from the axis of rotation; wherein the pin hole comprises an outer open end and an inner open end, and wherein a diameter of the outer open end is the same as a diameter of the pin hole, and a diameter of the inner open end is smaller than the diameter of the pin hole;

(e) a locking block cover attached to one side of the locking block where the outer open end of the pin hole is located, and the locking block cover is formed with a cover opening in alignment with the pin hole, wherein a diameter of the cover opening is smaller than the diameter of the pin hole;

(f) a pin insertable through an opening of a housing of the locking device and the cover opening and into the pin hole;

(g) a spring unit held inside the pin hole to facilitate ejection of the pin from the pin hole, the spring unit comprising a pin-actuating spring have two opposite ends and two steel balls disposed at the two opposite ends of the spring respectively; and (h) a locking block spring provided in a transverse recess formed on the locking block transverse to the pin hole for exerting a force to bias the locking block in a first bias position where the pin is inserted through the opening of the housing and into the pin hole and the locking block is held by the pin and is disengaged from the spindle follower linkage, and a second bias position where the pin is removed from the pin hole and the locking block is pushed towards and engaged with the spindle follower linkage, thereby preventing rotation of the spindle follower linkage and holding it in the locked position.

2. The locking device as claimed in claim 1, wherein the locking block is engageable with the spindle follower linkage by an engagement mechanism comprising a recess formed on the spindle follower linkage and a corresponding projection extending from the locking block and engageable with the recess.

3. The locking device as claimed in claim 1, wherein the pin comprises an insert end adapted to be inserted into the pin hole, and a gripping end adapted to extend outwardly from the housing of the locking device to facilitate gripping of the pin by fingers of a user.

4. The locking device as claimed in claim 3, wherein the gripping end is formed with an enlarged head.

5. The locking device as claimed in claim 1, wherein the latch, the latch linkage, the spindle follower linkage, the locking block and the pin are made of metal.

6. A locking device comprising:

(a) a spindle follower linkage coupled with a latch, the spindle follower linkage being rotatable about an axis of rotation between a locked position where the latch is in an extended position and an unlocked position where the latch is in a retracted position;

(b) a locking block formed with an elongate pin hole parallel to and spaced apart from the axis of rotation;

(c) a pin insertable through an opening of a housing of the locking device and into the pin hole; and (d) a locking block spring provided in a transverse recess formed on the locking block transverse to the pin hole for exerting a force to bias the locking block in a first bias position where the pin is inserted through the opening of the housing and into the pin hole and the locking block is held by the pin and is disengaged from the spindle follower linkage, and a second bias position where the pin is removed from the pin hole and the locking block is pushed towards and engaged with the spindle follower linkage, thereby preventing rotation of the spindle follower linkage and holding it in the locked position.

7. The locking device as claimed in claim 6, wherein a spring unit is held inside the pin hole to facilitate ejection of the pin from the pin hole.

8. The locking device as claimed in claim 7, wherein the spring unit comprises a pin-actuating spring have two opposite ends and two steel balls disposed at the two opposite ends of the spring respectively.

9. The locking device as claimed in claim 6, wherein the pin hole comprises an outer open end for passing therethrough the pin and an inner open end, and wherein a diameter of the outer open end is the same as a diameter of the pin hole, and a diameter of the inner open end is smaller than the diameter of the pin hole.

10. The locking device as claimed in claim 9, wherein the locking block comprises a locking block cover attached to one side thereof where the outer open end of the pin hole is located, and the locking block cover is formed with a cover opening in alignment with the pin hole, wherein a diameter of the cover opening is smaller than the diameter of the pin hole.

11. The locking device as claimed in claim 6, wherein the locking block is engageable with the spindle follower linkage by an engagement mechanism.

12. The locking device as claimed in claim 11, wherein the engagement mechanism comprises a recess formed on the spindle follower linkage and a corresponding projection extending from the locking block and engageable with the recess.

13. The locking device as claimed in claim 6, wherein the pin comprises an insert end adapted to be inserted into the pin hole, and a gripping end adapted to extend outwardly from the housing of the locking device to facilitate gripping of the pin by fingers of a user.

14. The locking device as claimed in claim 13, wherein the gripping end is formed with an enlarged head.

15. The locking device as claimed in claim 6, wherein the latch, the spindle follower linkage, the locking block and the pin are made of metal.

16. A door assembly comprising the locking device as claimed in claim 6.

* * * * *